United States Patent [19]

Wüsthof et al.

[11] 4,346,645

[45] Aug. 31, 1982

[54] HYDRAULIC AXIAL PISTON ENGINE

[75] Inventors: Peter Wüsthof, Lohr, Fed. Rep. of Germany; Sinclair Cunningham, Kinghorn, Scotland

[73] Assignee: G. L. Rexroth GmbH, Lohr, Fed. Rep. of Germany

[21] Appl. No.: 90,643

[22] Filed: Nov. 2, 1979

[30] Foreign Application Priority Data

Nov. 4, 1978 [DE] Fed. Rep. of Germany ..... 2847952

[51] Int. Cl.[3] ..... F01B 13/04

[52] U.S. Cl. ..... 91/501

[58] Field of Search ..... 91/492, 487, 499, 501

[56] References Cited

U.S. PATENT DOCUMENTS

| | | | |
|---|---|---|---|
| 2,842,068 | 7/1958 | Sondin | 91/501 |
| 3,657,970 | 4/1972 | Kobayashi | 91/487 |
| 3,760,691 | 9/1973 | Kleckner | 91/492 |
| 3,808,951 | 5/1974 | Martin | 91/492 |
| 3,975,990 | 8/1976 | Kraus | 91/499 |
| 4,075,843 | 2/1978 | Leker | 91/499 |

FOREIGN PATENT DOCUMENTS

| | | | |
|---|---|---|---|
| 2332584 | 1/1975 | Fed. Rep. of Germany | 91/499 |
| 1199497 | 12/1959 | France | 91/499 |
| 2386699 | 4/1977 | France | 91/499 |
| 450028 | 4/1975 | U.S.S.R. | 91/501 |

*Primary Examiner*—William L. Freeh

*Attorney, Agent, or Firm*—Michael J. Striker

[57] ABSTRACT

The hydraulic axial piston engine has a rotary shaft and a stationary control plate symmetrically connected to a two-piece housing supporting for rotation the shaft. Two stationary lifting cams are arranged opposite each other at the end walls of the housing around the shaft; two rotary cylinder blocks are supported for joint rotation on the shaft and each adjoins a face of the control plate; the end walls of the cylinder blocks facing the cams are provided with a plurality of uniformly distributed and axially directed blind bores for accommodating working pistons. The end walls in each blind bore has a through passage for working fluid and the control plate in the range of the passages has a plurality of uniformly distributed control openings connected alternately to two annular distributing channels formed in the plate, one of the channels being connected to an intake port and the other channel to a discharge port for the working fluid. The ends of the pistons are provided with thrust balls engaging the sinusoidal cam surface of the lifting cams.

5 Claims, 6 Drawing Figures

33f
33c
33d
27b
26b
T2
B
T1
34
A
33e
33b
33a
27a
26a
a
P
T
b
c
36
B1
A1
1
24b
25b
32
25a
24a
3
4R
4L
2
35

HYDRAULIC AXIAL PISTON ENGINE

BACKGROUND OF THE INVENTION

The present invention relates in general to hydraulic machines and in particular it relates to a hydraulic axial piston engine having a rotary shaft, stationary lifting cams arranged around the shaft, and two sets of axial pistons arranged opposite each other and cooperating with respective lifting cams to drive the shaft.

The hydraulic axial piston machines of this type known from prior art have the juxtaposed pistons arranged in a common bore formed in a cylinder block which is fixedly mounted in a machine housing. The pistons cooperate with assigned lifting cams which are connected for joint rotation to a shaft and thus transform their lifting force into a rotary movement of the shaft. The feeding and the discharge of the working fluid into or from the cylindrical spaces above the pistons takes place via recesses in the shaft whereby an axial section of the periphery of the shaft together with the corresponding inner wall surface of the cylinder blocks provides for the necessary control of the admitted or discharged working fluid. The working fluid is supplied through an inlet port and discharged through an outlet port, both ports being formed in the stationary machine housing and communicate via a rotary conduit with the recesses in the shaft.

Inasmuch as it is impossible to compensate for play both in the controlling sections and in the rotary conduit, relatively high losses due to the leakage of the working oil take place and these losses are still increased in the case when the shaft bends due to the radial forces transmitted thereon. Apart from the above-described leakage losses another disadvantage of the known radial piston machines is in the fact that the control surface is limited by the periphery of the shaft and consequently the prior art control enables only a limited power control of the machines.

SUMMARY OF THE INVENTION

It is therefore a general object of the present invention to overcome the aforementioned disadvantages.

More particularly, it is an object of the invention to provide an improved hydraulic radial piston engine which has reduced leaking losses.

Another object of the invention is to provide such an improved engine which has an increased efficiency.

Still another object of this invention is to provide an improved engine the control part of which is easy to manufacture.

A further object of the invention is to provide an improved engine of the aforedescribed type which facilitates by simple means to adjust its power in very narrow increments.

In keeping with these objects, and others which will become apparent hereafter, one feature of the invention resides, in a hydraulic axial piston engine of the aforedescribed type, in the provision of two stationary lifting cams arranged opposite each other around the rotary shaft, two rotary cylinder blocks arranged for joint rotation on the shaft and each having a plurality of uniformly distributed blind bores, a plurality of passages provided in each cylinder block at the bottom of respective blind bores, two sets of axial pistons arranged in the bores for reciprocating movement against the cams, a stationary control plate disposed between the cylinder blocks, the plate having a working liquid inlet port, a working liquid discharge port, two distributing channels each communicating with one of the ports, and two sets of uniformly distributed control openings communicating alternatively with respective distributing channels and with the passages in the rotary cylinder blocks.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
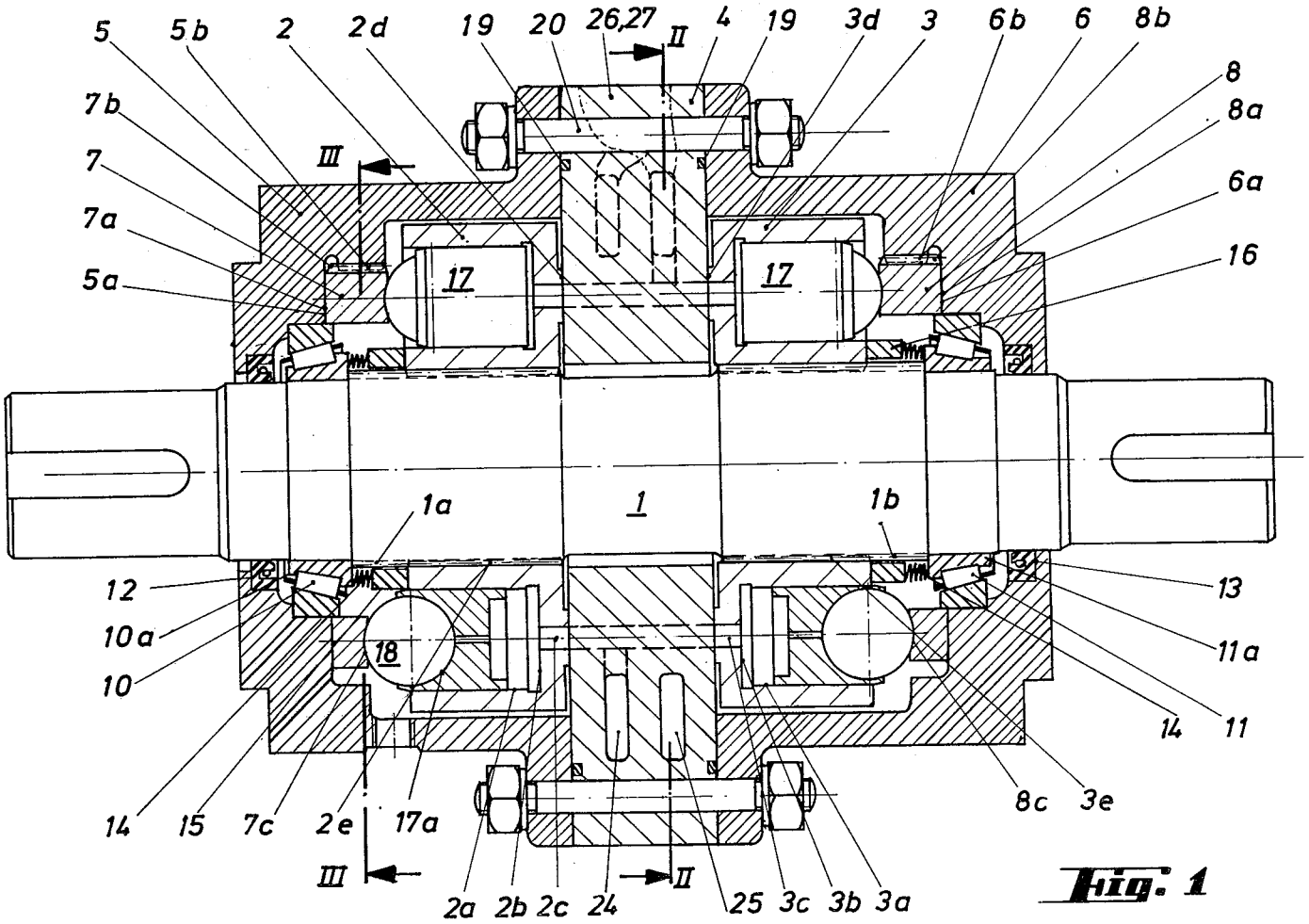
FIG. 1 is an axial cross section of an embodiment of the hydraulic axial piston engine of this invention in which the cylinder blocks are coupled directly to the rotary shaft for a joint rotation therewith.
Figure 3:
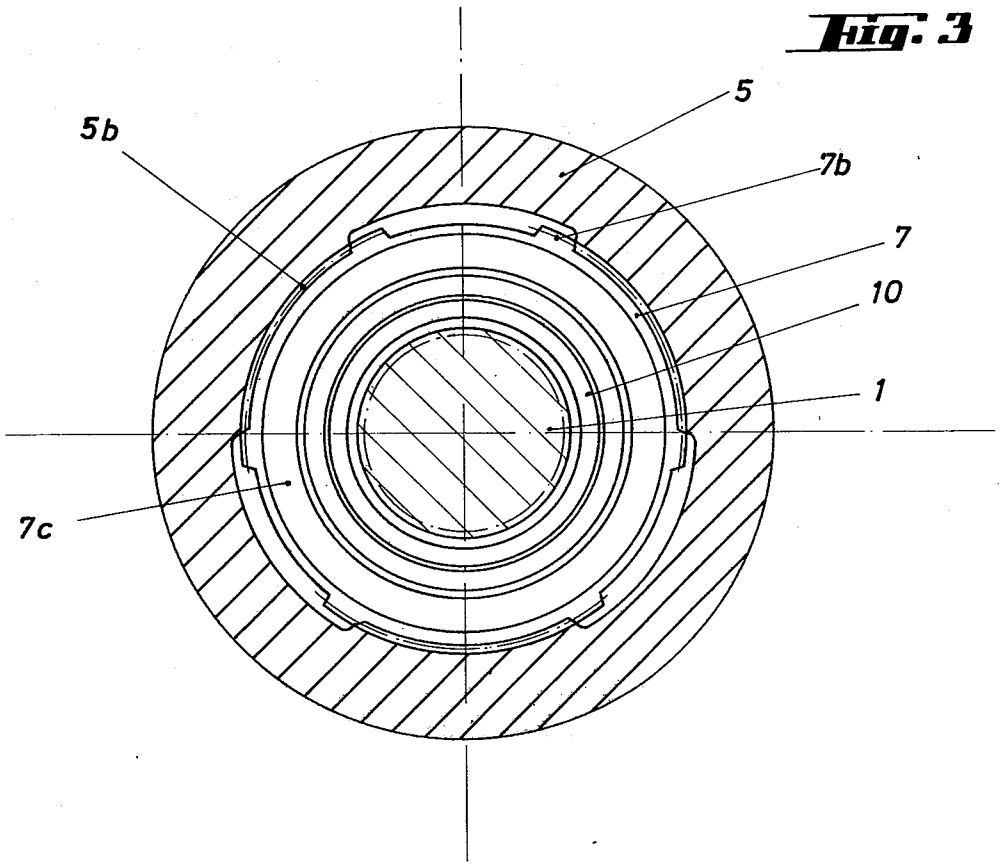
FIG. 3 is a sectional view of the machine of FIG. 1 taken along the line III—III.
Figure 4:
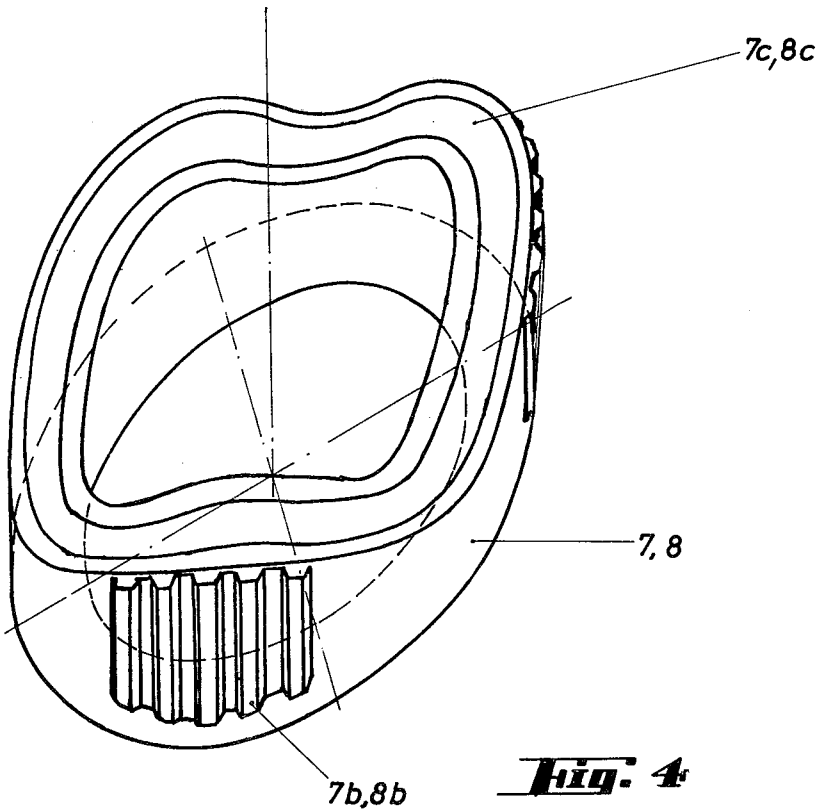
FIG. 4 is a perspective view of a lifting cam.

Referring firstly to FIG. 1, reference numeral 1 indicates a rotary through shaft provided on its periphery with two separate splines 1*a* and 1*b*. Annular cylinder blocks 2 and 3 are provided with corresponding inner splines 2*e* and 3*e* which engage the splines 1*a* and 1*b* thus connecting the cylinder blocks for joint rotation with the shaft. A stationary control plate 4 is arranged between the two rotary cylinder blocks and its opposite faces are connected by fastening screws 20 to flanges of two bell-shaped housing parts 5 and 6 whereby the mating surface portions are sealed against leakage by sealing rings 19. Both housing parts 5 and 6 enclose the rotary cylinder blocks 2 and 3 and support also the stationary lifting cams 7 and 8. For this purpose, the inner end wall of each housing part is provided with an annular stop surface 5*a* and 6*a* against which the corresponding end surfaces of respective lifting cams 7*a* and 8*a* abut. To secure these cams against rotation they are provided with locking teeth 7*b* and 8*b* which engage corresponding splines 5*b* and 6*b* on the inner wall of respective housing parts 5 and 6 (FIG. 3). As seen from FIG. 4, the locking teeth 7*b* and 8*b* are formed on discrete portions of the periphery of the cams 7 and 8 in the range where the cams have the largest axial extension. By means of this arrangement the cams are secured against rotation and at the same time the axial splines permit the centering of the cam surfaces 7*c* and 8*c* relative to the center of rotation of thrust balls 18 of the rotary cylinder blocks which roll thereon. The two housing parts support further both shaft bearings 10 and 11 in the form of taper roller bearings and two sealing rings 12 and 13 for preventing the leakage of working fluid along the shaft. The inner face of each shaft bearing is provided with uniformly distributed pressure springs 14 which urge thrust rings 15 and 16 against respective cylinder blocks 2 and 3 so that the latter are spring biased against the opposite faces of the control plate 4 and are thus kept in a positive sliding contact with the latter.

Figure 2:
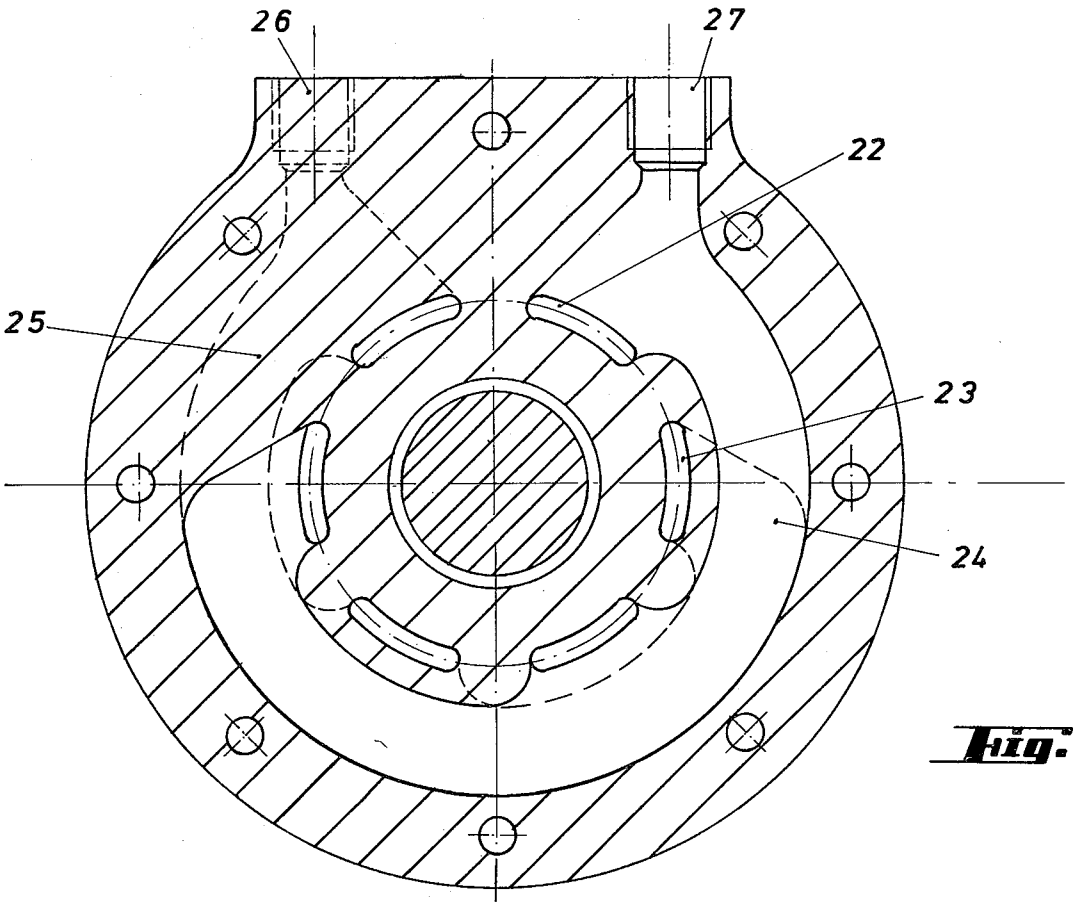
FIG. 2 is a sectional view of the machine of FIG. 1 taken along the line II—II.

The cylinder blocks 2 and 3 have the form of annular bodies provided with a plurality of uniformly distributed and axially directed blind bores 2*a* and 3*a* for receiving the axial pistons 17. The outer end surface of each piston 17 has a cup-shaped recess 17*a* for accommodating a thrust ball 18 which rolls on the cam surface 7*c* and 8*c* of respective lifting cams. The bottom walls 2*b* and 3*b* of respective blind bores 2*a* and 3*a* are provided with passages 2*c* and 3*c* for admitting the working liquid. These passages cooperate with control openings 22 and 23 formed in the control plate 4. By virtue of the provision of the control openings in the control plate, the size of these openings is independent from the diameter of the shaft 1. The control openings are preferably in the form of axially directed pass-through passages and consequently have the same shape on both opposite faces of the control plate 4. An intake port 26 and a discharge port 27 are formed in the periphery of the control plate 4 and the control openings 22 and 23 are alternately connected via the distributing annular channels 24 and 25 to the discharge port 27 and to the intake port 26 (FIG. 2). The annular distributing channels are spaced apart from the mating surfaces 2*d* and 3*d* between respective cylinder blocks and the control plate 4 and consequently any deformation of the control plate is practically excluded and leakage losses which otherwise might result on these mating surfaces 2*d* and 3*d* are reduced to a minimum.

The cam surfaces 7*c* and 8*c* of the lifting cams have a sinusoidal configuration (FIG. 4) defining three valleys and three crests whereby the difference between the minimum and the maximum axial extension of these cam surfaces determine the maximum stroke of the working piston. The respective lifting cams are situated relative to the control plate 4 at such an angular position that the ranges of the cam surfaces between the maximum and the minimum value and vice versa form the same central angle as the corresponding ranges of the control openings in the control plate.

Shaft 1 is set in rotation in response to the admission of the working fluid through passages 2*c* and 3*c* into cylinders where the pistons 17 are retracted and consequently a pressure is applied on these pistons in the direction against the cams 7 and 8. This pressure is transmitted via the thrust balls 18 on respective cams and according to the angle of the loaded sinusoidal portion of the cam surface the pressure is divided into axial and tangential components whereby the pressure components whereby the pressure components acting in tangential direction generate a rotary moment in the cylinder blocks 2 and 3 which in turn due to their positive coupling to the shaft 1 set the latter into rotary motion. Due to the fact that the number of working pistons 17 is larger than the number of control openings 22 and 23, at least two working pistons are always connected to a control opening which is under the pressure of the working fluid and consequently no dead center point of the hydraulic engine can take place.

Figure 5:
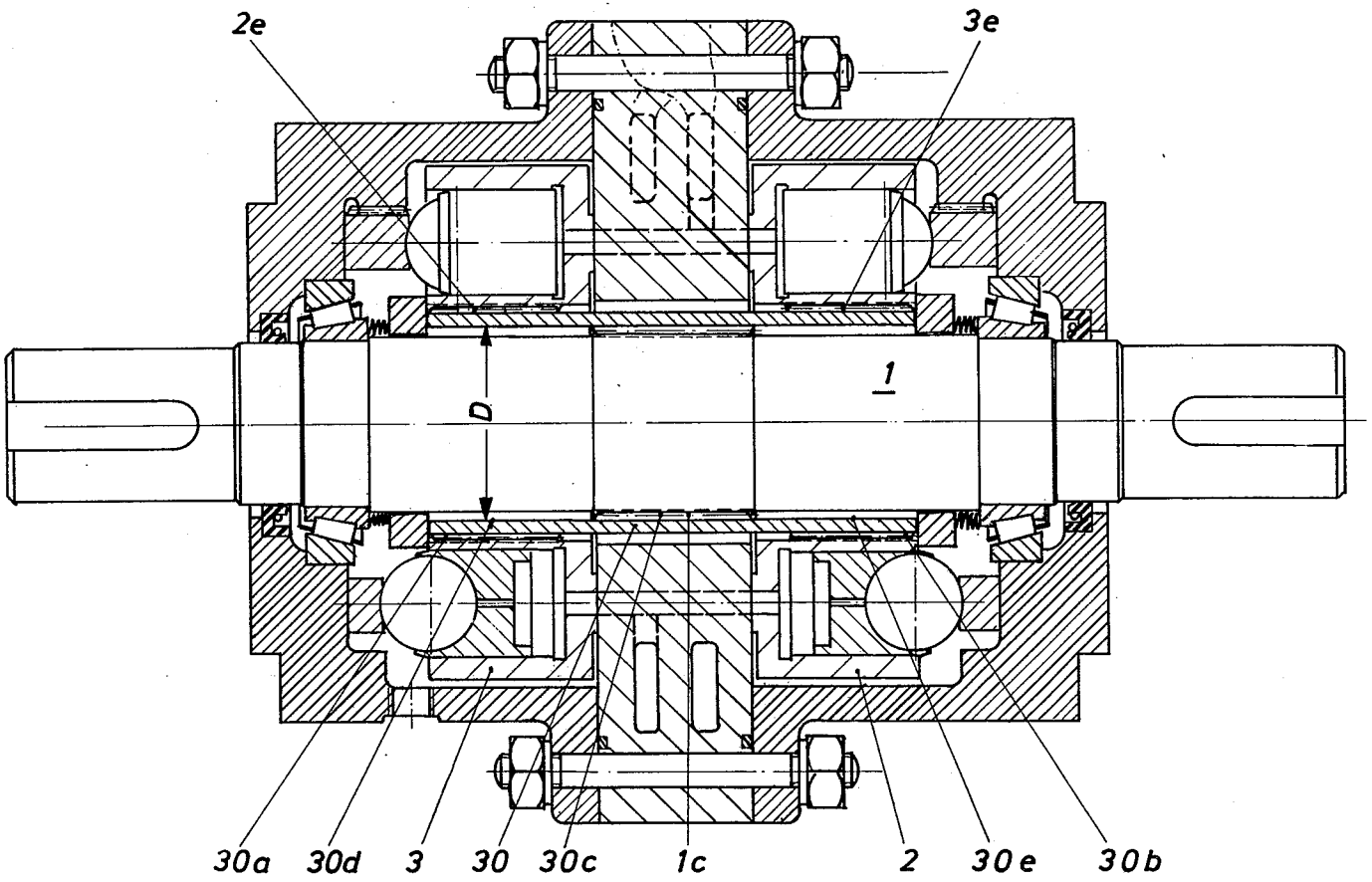
FIG. 5 is an axial cross section of another embodiment of the hydraulic axial piston engine in which the cylinder blocks are connected to the rotary shaft via a splined sleeve.

In the embodiment of the hydraulic axial piston engine of this invention as illustrated in FIG. 5, the rotary cylinder blocks 2 and 3 are not splined directly to the shaft 1 as in the preceding embodiment of FIG. 1 but are coupled to the shaft by means of an intermediate splined sleeve 30. The sleeve 30 has at the end portion of its outer periphery sections provided with outer splines 30*a* and 30*b* which engage corresponding inner splined sections 2*e* and 3*e* on the inner wall of respective cylinder blocks 2 and 3. In addition, sections of the central part of the inner wall of the sleeve 30 are provided with inner splines 30*c* which engage corresponding splined sections 1*c* on the periphery of shaft 1. The inside diameter D of the sleeve when measured from the lateral nonsplined portions 30*d* and 30*e* is larger than the outer diameter of the shaft 1 in this area about an amount corresponding to the flexture or bending of the shaft resulting from the radial forces applied on the latter. As a consequence, the bending of the shaft cannot influence negatively the flat abutment surfaces between the rotary cylinder blocks and surfaces 2*d* and 3*d* of the control plate 4.

In order to attain a fine graduation of the power control of the hydraulic machine the curve of the cam surface of one lifting cam can be selected such as to impart a larger stroke to the assigned set of working pistons than the cam pertaining to the opposite set of pistons in the other cylinder block. A small power graduation can be also attained by a different number of working pistons in respective cylinder blocks.

Figure 6:
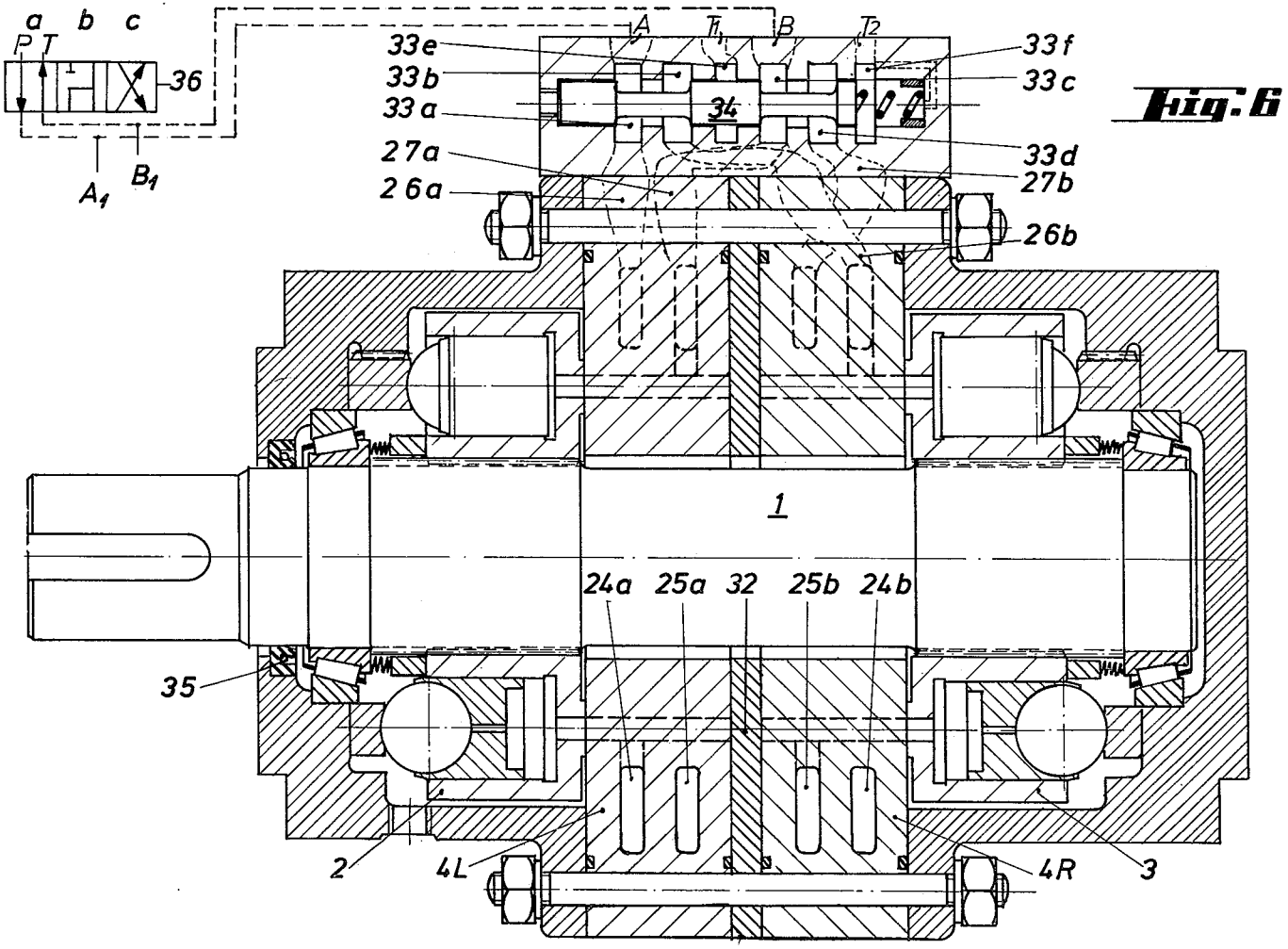
FIG. 6 is an axial cross section of still another embodiment of the hydraulic axial piston engine of this invention.

In the embodiment according to FIG. 6 there are provided two parallel control plates 4L and 4R assigned respectively to the rotary cylinder blocks 2 and 3 whereby the throughgoing control openings 24*a* and 25*a* in one control plate are separated from the juxtaposed control openings 25*b* and 24*b* in the other control plate by an intermediate separating plate 32. The intake ports 26*a* and 26*b* as well as the discharge port 27*a* and 27*b* in respective control plates 4L and 4R cooperate with a control valve 33 having two switching positions. A four-way valve 36 having three switching positions is connected to the control valve 33 via conduits $A_1$ and $B_1$. In the switching position $A_1$ of the fourway valve 36 as illustrated in FIG. 6, a pump P is connected to the port A and a tank T is connected to the port B of the valve 36. In the illustrated position of the slide 34 of the control valve 33 as illustrated in the Figure, the intake ports 26*a* and 26*b* are connected to the port A and the discharge ports 27*a* and 27*b* are connected to the port B. The corresponding intake and discharge ports of both control plates 4L and 4R are thus connected in parallel and consequently the pressure of the working fluid is admitted into the working cylinders or blind bores in both rotary cylinder blocks.

In another switching position of the control valve 33 the control spaces 33*a*, 33*b*, 33*c* and 33*d* are separated from one another and so are the corresponding intake and discharge ports of the two control plates 4L and 4R. In addition, the intake port 26*a* of the control plate 4L is connected to the port A and the discharge port 27*a* is connected to the port B of the control valve 33. By contrast, the intake port 27*b* of the control plate 4R is connected via control spaces 33*b* and 33*c* to the tank connection $T_1$ and the discharge port 27*b* is connected via control spaces 33*d* and 33*f* to the tank connection $T_2$. As a result, cylinder block 3 rotates jointly with the shaft 1 without transmitting thereto any rotary moment.

In the switching position c of the fourway valve 36 an exchanger of the intake and discharge ports for the working fluid takes place. The intake ports 26*a* and 26*b* of the control plates become the discharge ports and the discharge ports 26*a* and 27*b* become the intake openings and consequently the shaft 1 reverses the direction of its rotation. In the intermediate position b of the fourway valve 36 all intake and discharge ports of both control plates are connected to the tank. As a consequence, in this position b none of the two rotary cylinder blocks can impart a rotary moment to the shaft and the latter can be freely rotated. Due to the fact that one or the other of the two cylinder blocks can be separated from the source of working fluid, the hydraulic engine of this invention can be employed in an economic manner in installations where variable power is required. The passthrough openings for the shaft in the housing parts can be sealed by high pressure resistant sealing rings 35 so that the hydraulic engines can be connected in series.

It will be understood that each of the elements discussed above, or two or more together, may also find a useful application in other types of constructions differing from the types described above.

While the invention has been illustrated and described as embodied in specific examples of the hydraulic axial piston engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic axial piston engine comprising: a rotary shaft; a pair of stationary lifting cams defining two facing cam surfaces arranged around said shaft; two rotary cylinder blocks supported for joint rotation on said shaft and each having a plurality of uniformly distributed and axially directed blind bores; through passages provided in the end wall of each blind bore to admit and discharge a working liquid into respective bores; two sets of working pistons arranged for reciprocating movement in said bores in contact with said cam surfaces; a stationary control plate of a substantially ring-shaped configuration defining a jacket and two annular end surfaces, an inlet port and an outlet port formed, respectiely, in said jacket, a plurality of uniformly distributed control openings formed in said end surfaces, two distributing channels arranged in said control plate at a spaced relationship and parallel to said end surfaces, each of said distributing channels communicating with one of said ports and with a set of alternate control openings; said control openings communicating with said passages in the rotary cylinder blocks; a two-piece housing mounted on said control plate and supporting said shaft for rotation and having inner wall portions which fixedly support said lifting cams, said inner wall portions being provided with inner splines and the outer periphery of said cams being provided with outer splines engaging said inner splines.

2. The hydraulic axial piston engine as defined in claim 1, further including means for resiliently urging said rotary cylinder blocks against the adjoining surfaces of said control plate.

3. The hydraulic axial piston engine as defined in claim 1, wherein each piece of said housing has a bell-shaped configuration having its end wall provided with thrust bearings for supporting said shaft, and with sealing rings.

4. A hydraulic axial piston engine comprising: a rotary shaft; a pair of stationary lifting cams defining two facing cam surfaces arranged around said shaft; two rotary cylinder blocks supported for joint rotation on said shaft and each having a plurality of uniformly distributed and axially directed blind bores; through passages provided in the end wall of each blind bore to admit and discharge a working liquid into respective bores; two sets of working pistons arranged for reciprocating movement in said bores in contact with said cam surfaces; a stationary control plate of a substantially ring-shaped configuration defining a jacket and two annular end surfaces, an inlet port and an outlet port formed, respectiely, in said jacket, a plurality of uniformly distributed control openings formed in said end surfaces, two distributing channels arranged in said control plate at a spaced relationship and parallel to said end surfaces, each of said distributing channels communicating with one of said ports and with a set of alternate control openings; said control openings communicating with said passages in the rotary cylinder blocks; an additional control plate separated from said first-mentioned control plate by a separating plate and each of said control plates adjoining one of said rotary cylinder blocks, a control valve having at least two switching positions, an intake connection, a discharge connection and two tank connections, said connections being connected to respective intake and discharge ports of said control plates in such a manner as to ensure a parallel connection of both control plates in one switching position and a short circuit of said ports to said tank connections in another switching position.

5. The hydraulic axial piston engine as defined in claim 4, further including a multiway control valve having a switching position in which the inlet ports and the discharge ports of both control plates are connected one to another via said tank connection.

* * * * *